United States Patent [19]

Akunov et al.

[11] 4,019,688

[45] Apr. 26, 1977

[54] DEVICE FOR TREATING LOOSE MATERIALS

[76] Inventors: Viktor Ivanovich Akunov, Nagatinskaya ulitsa, 83, korpus 2, kv. 420; Ivan Timofeevich Blinov, Kutuzovsky prospekt, 30/32, kv. 801; Viktor Fedorovich Boryakov, Begovaya alleya, 3, kv. 198; Nikolai Evgenievich Ermolaev, Vostochnaya ulitsa, 1/7, korpus 4, kv. 68; Georgy Vladimirovich Zavadsky, Rizhsky proezd, 7, kv. 79; Vladimir Viktorovich Lopatin, prospekt Vernadskogo, 61, kv. 19; Gennady Fedorovich Rusakov, ulitsa Butlerova, 14, korpus 2, kv. 205, all of Moscow, U.S.S.R.

[22] Filed: June 2, 1975

[21] Appl. No.: 583,093

[52] U.S. Cl. ..... 241/39; 241/79

[51] Int. Cl.[2] ..... B02C 19/06

[58] Field of Search ..... 241/68, 79, 80, 39

[56] References Cited

UNITED STATES PATENTS

| | | | |
|---|---|---|---|
| 2,602,595 | 7/1952 | Thomas | 241/68 X |
| 2,672,296 | 3/1954 | Venable | 241/68 X |
| 3,017,993 | 1/1962 | MacPherson et al. | 241/68 X |

*Primary Examiner*—Granville Y. Custer, Jr.

[57] ABSTRACT

A device, comprising injectors built in a chamber and directed toward each other, and a separator connected to them through pipelines, each pipeline accommodating a built-in additional separator adapted to withdraw a fraction of the finished product remained in the material to be returned into the injectors for additional treatment.

1 Claim, 1 Drawing Figure

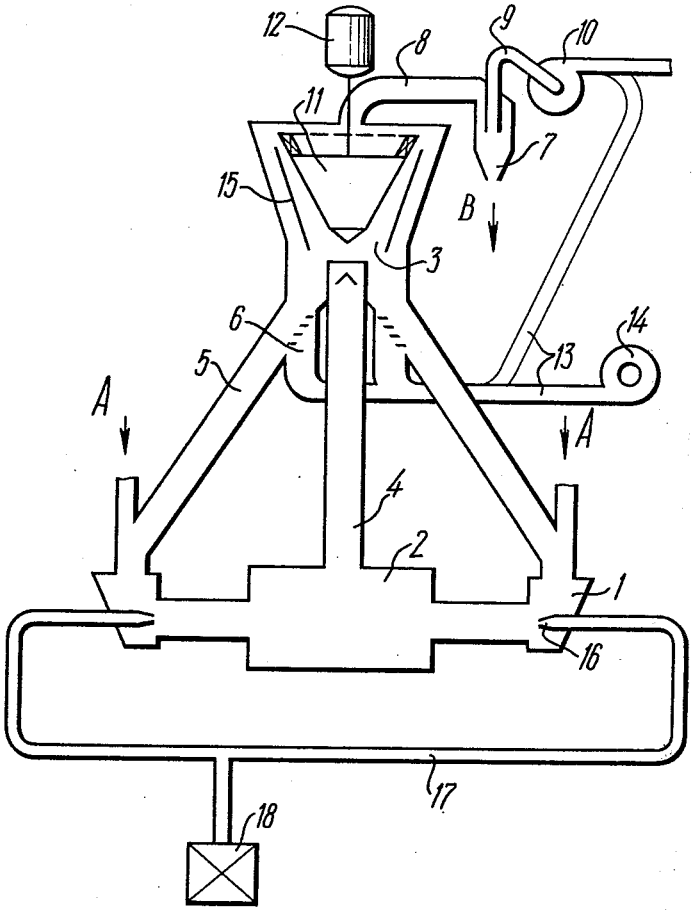
12
8
9
10
11
7
15
B
3
6
14
13
5
A
A
4
2
1
16
17
18

DEVICE FOR TREATING LOOSE MATERIALS

The present invention relates to devices for treating loose materials, such as, sand, chips and other rock products, various ores, metallurgical moulding sands, salts, fertilizers, reagents and other chemicals, grain, bones and other agricultural and cattle-breeding products as well as salt, sugar, dried vegetables, fruits and other foodstuffs.

The invention proves to be most advantageous in ore mining, in the metallurgical, chemical and food industries, and in the construction materials industry.

Depending on the treatment of the loose materials the herein-proposed device can be used for comminuting the materials to any desired degree — from fractions of a decimeter to those of a micron, for mixing and homogenizing of several materials, for cleaning and surface stripping of materials being treated, for isolation of particular components from the bulk ore being crushed, drying damp loose materials and their burning, if required, for continuous running of chemical reactions between materials being treated in the device, e.g. etching of loose material with acid, alkali or gas.

Commonly known is a device for treating loose materials which is an air-stream mill, comprising injectors wherein the material being comminuted is entrained by an energy carrier and accelerated to a speed approximating that of the energy carrier, and a chamber in which the injectors are built-in coaxially and directed toward each other. The chamber ensures free collision and fracturing of the material being comminuted. The device comprises also a separator communicating with the chamber and adapted to withdraw the finished product from that having been comminuted inadequately, or from the semifinished product, the separator being connected to the injectors through pipelines discharging the semifinished product for additional comminution (see, e.g., a book by Akunov V.I. "Air-Stream Mills", Mechanical Engineering State Publishing House, Moscow, 1967, pp. 139–142, 153–166, 167–168).

In the known devices the separators ensure, as a rule, the withdrawal of up to 90% of finished product from the comminuted material. The remaining 10–20% of the finished product, entrained by the stream of semifinished product, return to the injectors to be again subjected to unnecessary treating cycle. This involves additional consumption of compressed gas, electric and other kinds of energy at all stages of the material treating process. The device output is accordingly decreased and the specific wear of its internal working surfaces (lining) increased, which is accompanied with a corresponding contamination of the finished product. Excessive comminution of the material increases the amount of a fine fraction over the required quantity. All the above results in a substantial increase in the treatment cost of the materials in the prior-art device as compared with that obtainable in case the finished product would not have been returned for additional comminution.

The main object of the present invention is the provision of a device for treating loose materials ensuring a higher degree of the withdrawal of the finished product from material being treated, as compared with the known device, and enhancing thereby the device output.

Another object of the invention is to provide a device for treating loose materials ensuring the production of the finished product of a requisite quality of decreasing contamination of the finished product with device lining wear products and by eliminating excessive comminution of material.

These and other objects are achieved by providing a device for treating loose materials in counterflow with the aid of injectors built-in a chamber and directed toward each other, and a separator communicating with the chamber and connected to the injectors through pipelines. According to the invention, each pipeline connecting the separator to the injectors accommodates a built-in additional separator to withdraw a fraction of the finished product that remains in the material to be returned into the injectors for additional treatment.

The essence of the present invention consists in the following.

The particles of semifinished product returned from the main separator of the device into the injectors for additional treatment are exposed in the additional separator to intense blowout, mainly a transverse blowout, i.e. in a direction normal to the flow of the semifinished product. Owing to high-rate blowing, the finely comminuted and dried particles of the finished product, torn off from the surface of the coarse grains of the semifinished product that entrains them, are carried away by a gas stream to a material store or to the location of further usage. Mutual abrasive effect of the particles, originating in their flow during the transverse blowout, adds to the process of separation of the particles of finished product entrained with the semifinished product.

Thus, a fraction of the finished product (5–20% depending on comminution fineness, material humidity and on the type of the main separator) which has been withdrawn in the main separator, would be trapped and would not get into the injectors, discharge pipelines and main separator. Therefore the device output will grow as many percent, with the consumption of the expensive energy carrier being the same and the product being not exposed to excessive comminution. The service life of the lining will be extended by 1.5–2 times since a decrease in the degree of material comminution results in a substantial reduction in its abrasive properties.

The blowout of the semifinished product with hot gas in the additional separator makes it possible to accomplish additional operations, such as, burning or drying of the semifinished products, which, in case of inadequate burning or the need in drying coarse grains of material being treated, may give considerable economic effect.

The nature of the invention will be clear from the following detailed description of a particular embodiment thereof, to be had in conjunction with the accompanying drawing, in which:

FIG. 1 is a schematic layout of a device for treating loose materials, according to the invention (longitudinal section).

Referring to the drawing, the device is an air-stream mill in which material, such as sand, solid fuel, cement, graphite, etc., is comminuted due to collisions of its particles.

The device comprises two injectors 1 directed toward each other and built in a chamber 2, a main separator 3 communicating with the chamber 2 through a pipeline 4, pipelines 5 connecting the main separator 3 to the injectors 1, and additional separators 6 built in each pipeline 5.

The injectors 1 are intended to accelerate the particles of the initial material admitted into the chamber 2 to be treated therein (for grinding, stripping, and other operations and in case a hot energy carrier is fed — for drying or burning).

The pipeline 4 is adapted for conveying the treated material into the main separator 3 withdrawing the finished product from inadequately treated semifinished product in a gaseous suspension flow.

The pipelines 5 serve to return the semifinished product withdrawn by the separator 3 into the injectors 1.

The additional separators 6 are adapted to isolate a fraction of the finished product from the material (semifinished product) returned into the injectors 1 for additional treatment. The preferred location of each additional separator 6 is the top portion of the pipeline 5, partial butting against the bottom portion of the main separator 3 being also possible. This is accounted for by the finished product having less chance to be contaminated with the settling semifinished product in the top portion of the pipeline 5.

To withdraw the gaseous suspension of the finished product in the energy carrier to their separation place in a vortex deduster 7, a pipeline 8 is built in the separator 3. The vortex deduster 7 is connected to a fan 10 through a pipeline 9.

Since in the herein-described particular embodiment of the invention use if made of a flick-whirlpool separator with a rotor 11, the separator 3 is fitted with an electric drive 12.

With separators of certain types there is no need in the pipeline 4, the chamber 2 being connected in that case directly to the main separator 3.

In this embodiment the additional separator 6 is a system of louver plates or sectional strips inclined to the flow of the semifinished product returned to the injectors.

The additional separators 6 are connected either to a fan 14 or to the fan 10 by means of a pipeline 13.

The main separator accommodates a cone-shaped hollow member 15 which acts as a protection means preventing the gaseous suspension of the product withdrawn by the additional separator 6 from mixing with that of the material being separated in the main separator 3.

Connected to nozzles 16 of the injectors 1 is a pipeline 17 through which the energy carrier is delivered under pressure from a compressor or boiler house or from another energy carrier source 18.

The herein-proposed device operates in the following manner. Material to be comminuted is delivered to injectors 1 as shown with arrows A. The particles of the material entrained in the injector by the streams of a gaseous energy carries, such as compressed air, superheated steam, etc., supplied through nozzles 16 under a pressure of 0.05–50 atm. from a gas source 18 along pipelines 17, are accelerated and expelled at a high speed into the chamber 2.

In the chamber 2 the material particles are comminuted, due to their collisions with one another, and dried simultaneously with the aid of the energy carrier.

The same energy carrier entrains the comminuted material in the form of a gaseous suspension into the pipeline 4 wherefrom it flows into the separator 3.

In the separator 3 under the effect of a centrifugal force of the rotor 11 the larger particles of the material are thrown to separator walls and descend along the pipeline 5 into the injectors 1 for additional comminution in the chamber 2.

The fine particles of the comminuted material corresponding in size to a requisite comminution fineness of the finished product, are entrained from the separator 3 in the form of a gaseous suspension in the gaseous energy carrier along the pipeline 8 into the vortex deduster 7 where, upon being isolated from the gas, they are passed to the place of their future usage or to a storage (as shown with arrows B). The gas separated from the product is removed from the device along the pipeline 9 with the aid of the fan 10.

Usually the additional separators 6 are fed with atmospheric air supplied by the fan 12 or with a fraction of the energy carrier exhausted by the fan 8.

If an intense drying or heating of the comminuted material is required, atmospheric air is replaced with hot waste gases of neighbouring thermal units.

Gas is delivered into the additional separators 6 along the pipelines 13, passes through their louvers into the pipelines 5 blowing the particles of the entrained finished product out of the semifinished product returned into the injectors.

The particles suspended in the gas supplied along the pipeline 13 flow into a space between the cone-shaped member 15 and a separator housing, which precludes the possibility of their mixing again with the material being withdrawn in the main separator. The dimensions of the cone-shaped hollow member are selected depending on the process parameters and material being comminuted.

Further, the particles of the finished product mixing with the gaseous suspension of the finished product isolated in the main separator, are withdrawn from the separator 3 along the pipeline 8.

The herein proposed device for treating loose materials ensures a higher, by 5–20%, as against the known devices, output, with the same consumption of expensive energy carrier. It precludes excessive comminution of material, extending the service life of the injector and chamber lining by 1.5–2 times and that of the discharge pipelines by 20%.

What we claim is:

1. A device for treating loose material in counterflow, comprising: a chamber defined in a housing; injectors built in said chamber and directed toward each other; a main separator including a central rotor communicating with said chamber and said injectors; pipelines through which said separator is connected to said injectors; additional separators for withdrawing a fraction of the finished product that remains in the material to be returned into said injectors for additional treatment, said additional separators being built in at least one of said pipelines; and a cone-shaped hollow member accommodated in said main separator about said rotor thereof to prevent the gaseous suspension of the finished product being withdrawn in an undesirable manner by said additional separators.

* * * * *